US007309237B2

(12) United States Patent
Kuo

(10) Patent No.: US 7,309,237 B2
(45) Date of Patent: Dec. 18, 2007

(54) MICRO COAXIAL CABLE CONNECTOR ASSEMBLY WITH GROUNDING MECHANISM

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/591,368

(22) Filed: Oct. 31, 2006

(65) Prior Publication Data

US 2007/0099506 A1 May 3, 2007

(30) Foreign Application Priority Data

Oct. 31, 2005 (CN) ..... 2005 2 0076964 U

(51) Int. Cl.
*H01R 12/00* (2006.01)

(52) U.S. Cl. ..... 439/63; 439/495

(58) Field of Classification Search ..... 439/63, 439/495–497, 607, 610, 660
See application file for complete search history.

(56) References Cited

U.S. PATENT DOCUMENTS 7,118,383 B2 * 10/2006 Nagata et al. ..... 439/63
7,198,492 B2 * 4/2007 Shichida et al. ..... 439/63
2006/0172589 A1 8/2006 Watanabe et al.

FOREIGN PATENT DOCUMENTS

CN 200520068913.3 5/2006

* cited by examiner

*Primary Examiner*—Khiem Nguyen
(74) *Attorney, Agent, or Firm*—Wei Te Chung

(57) ABSTRACT

A cable connector assembly (100) includes at least a cable (4); an insulating housing (2); a series of contacts (27) which are fixed in the insulating housing (2) to contact with the cable (4) electrically; a metal shield (1) engages with said insulating housing to shield the contacts (27) and cable (4); a bended grounding bar (32) is set between the insulating housing and cables, said bended grounding bar (32) formed an insert face (321) and a cover face (322), the insert face (321) electrically contact with the braid layer (42) of said cables and the cover face (322) covers on the insulating housing to screen it.

20 Claims, 8 Drawing Sheets

MICRO COAXIAL CABLE CONNECTOR ASSEMBLY WITH GROUNDING MECHANISM

BACKGROUND OF THE INVENTION

1. Field of the Invention

The present invention generally relates to a cable connector assembly, and more particularly to a cable connector assembly with grounding bar.

2. Description of Related Art

In the previous invention, the electric connector with grounding bar is popular to provide. Grounding bar is a metallic plate to connect with metal braid layer or grounding cable or shield so as to realize the grounding of the metal braid layer. However, the shield is used to accept the grounding bar, so a volume of shield is big, and a figure of the shield is complex, and this will increase the cost of manufacture and the difficulty of the design.

Hence, an improved cable connector assembly is provided in the invention to address the problems mentioned above and meet the current trend.

BRIEF SUMMARY OF THE INVENTION

Accordingly, an object of the present invention is to provide a cable connector assembly, which can achieve the function of grounding and be easy to make.

In order to achieve the above object, a cable connector assembly in accordance with the present invention comprises a plurality of cables; an insulating housing comprising a plurality of grooves to receive said cables; a series of contacts are fixed in the insulating housing to connect the wire of the cable electrically; a metal shield covering on said insulating housing to shield the contacts; a bended grounding bar is set between the insulating housing and cables, said bended grounding bar formed by an insert face and a cover face, the insert face electrically contact with the braid layer of said cables and the cover face is covering on the insulating housing to screen it.

Other objects, advantages and novel features of the invention will become more apparent from the following detailed description of the present embodiment when taken in conjunction with the accompanying drawings.

DETAILED DESCRIPTION OF THE INVENTION

Figure 1:
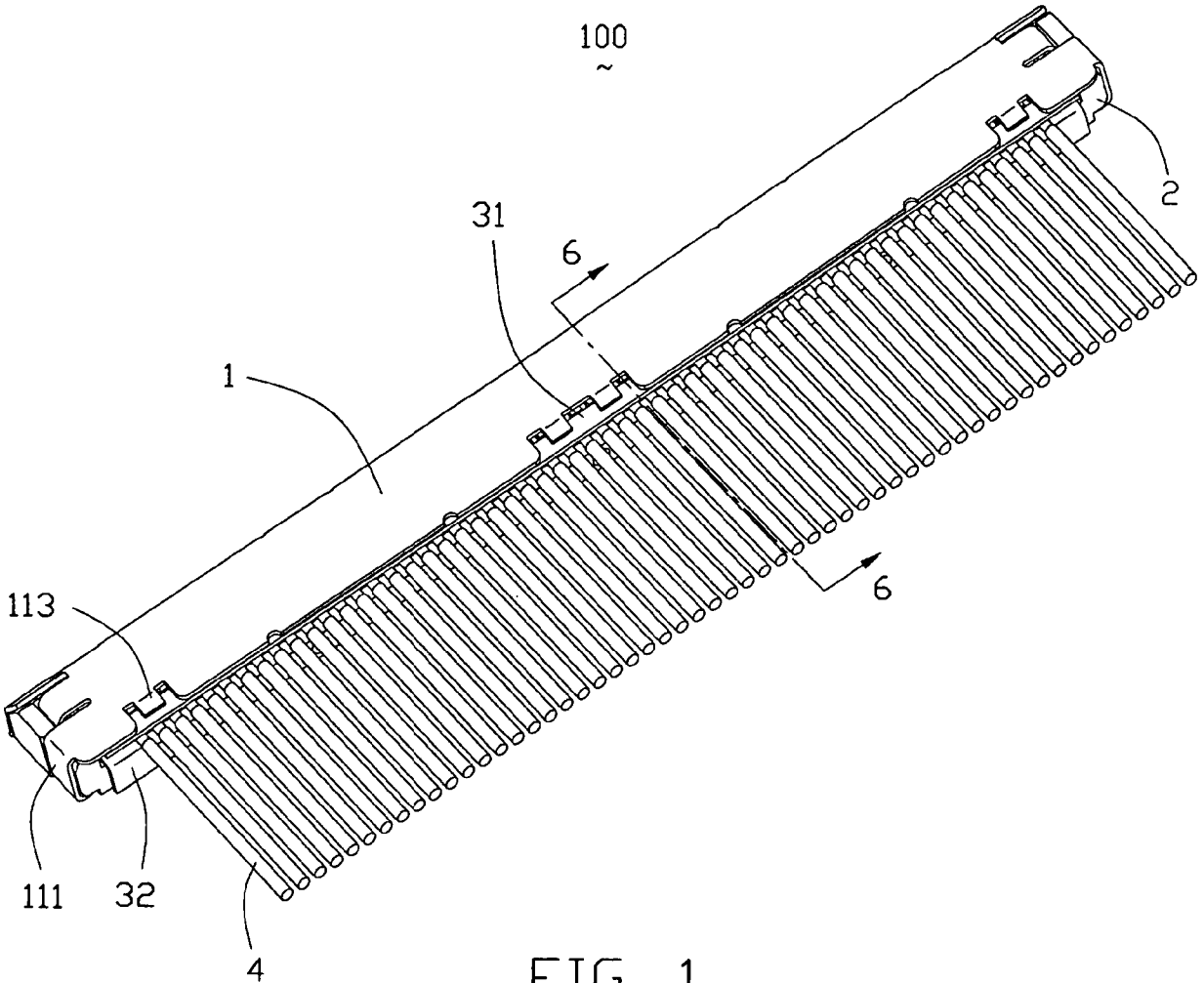
FIG. 1 is a perspective view of a cable connector assembly of the present invention.

Reference will now be made to the drawing figures to describe the present invention in detail.

Figure 2:
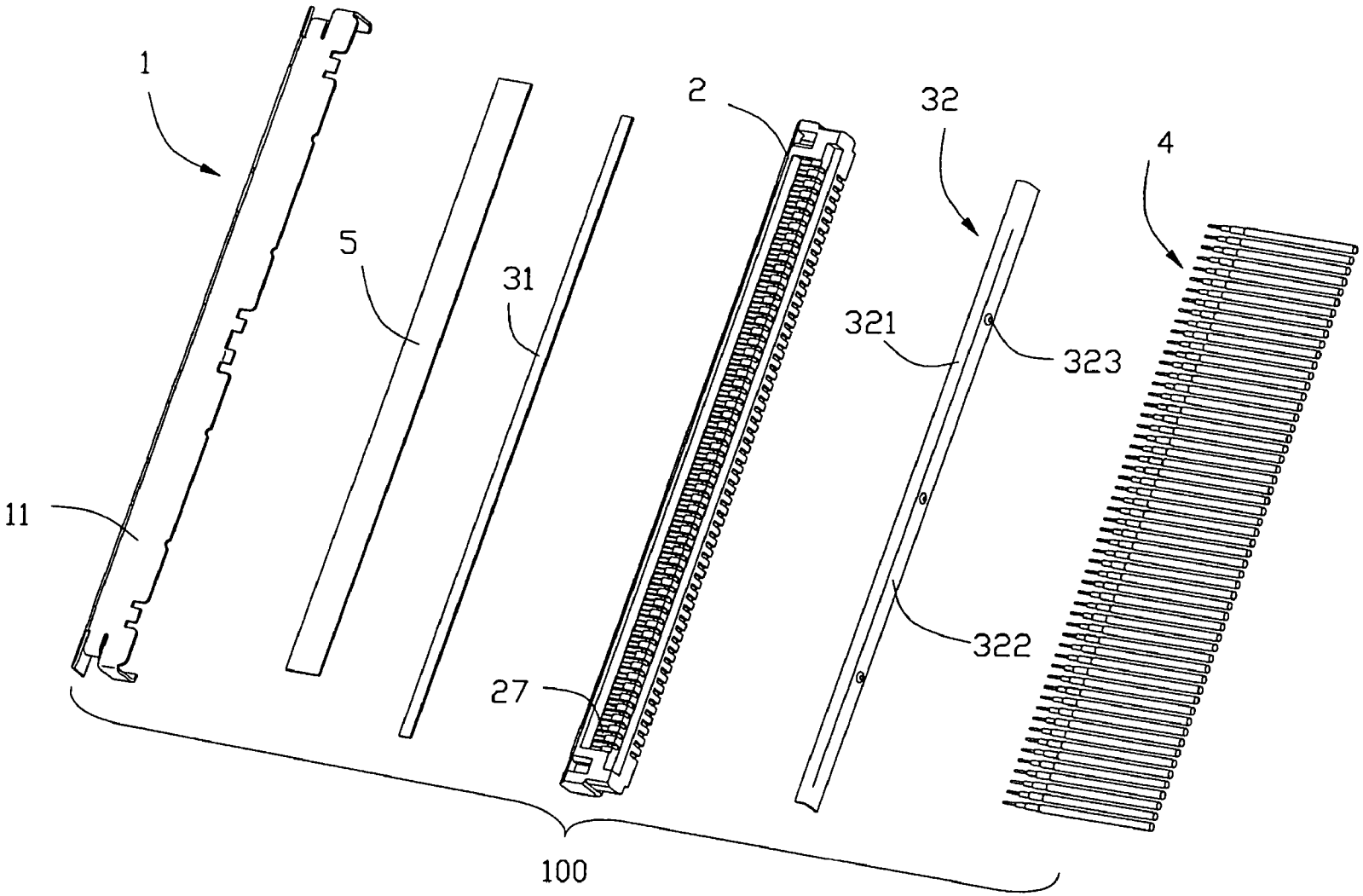
FIG. 2 is an exploded, perspective view of a cable connector assembly of the present invention.

Referring to FIGS. 1-2, a cable connector assembly 100 of the present invention comprises a metal shield 1, an insulating housing 2 which is located in metal shield 1, a plurality of the contacts 27 which are located in the insulating housing 2, and a plurality of cables 4, a flat grounding bar 31 and a bended grounding bar 32 respectively located on the upside and downside of the cable 4, an insulating plate 5 located between the metal shield 1 and cable 4.

Figure 6:
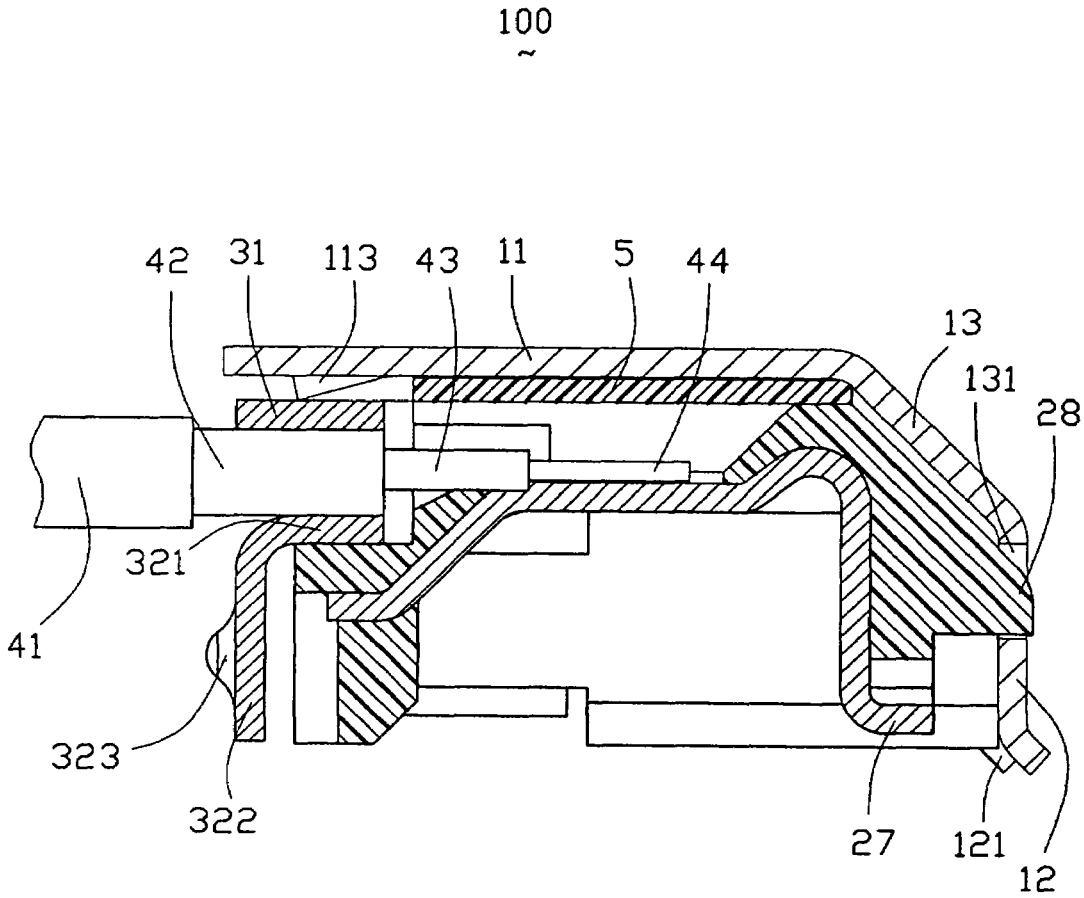
FIG. 6 is a cross-section view taken along line 6-6 of FIG. 1.

Referring to FIG. 2 and FIG. 6, viewed from center to outer, each cable 4 comprises a wire 44, an insulating layer 43, a metal braid 42 and an insulating shroud 41. The metal braid 42 connects with the bended grounding bar 32 for shielding the wire 44 and achieving a grounding performance.

Figure 3:
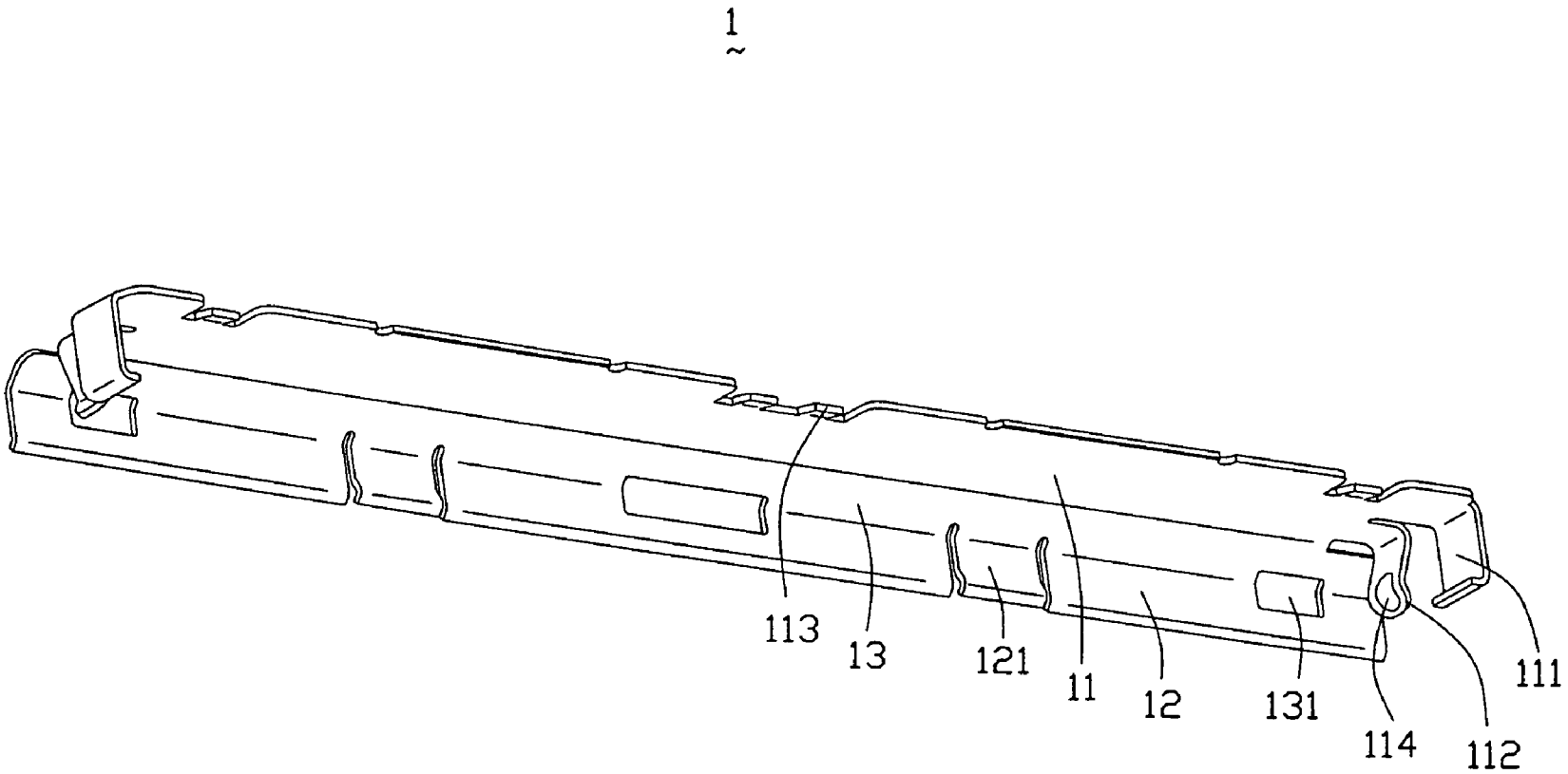
FIG. 3 is a perspective view of shield of the cable connector assembly of FIG. 1.

Please referring to FIG. 3, the metal shield 1 comprises an up plate 11, a front plate 12 and an inclined plate 13. The up plate 11 is generally vertical to the front plate 12, and the inclined plate 13 connects the up plate 11 and the front plate 12. The up plate 11 extends along a longitudinal direction there of, on the two ends of the up plate 11, two locking portions 111 and two inserting portions 112 are formed respectively by bending the two ends of the up plate 11. Each inserting portion 112 has a protruding portion 114 for retaining the insulating housing 2. For electrically connecting with the flat grounding bar 31, the up plate 11 comprises a plurality of touch portions 113 which extend backwardly from the up plate 11. The conjunction of the front plate 12 and inclined plate 13 has at least a rectangular hole 131; the front plate 12 has a plurality of the retaining portions 121 for fastening the insulating housing 2.

Figure 4:
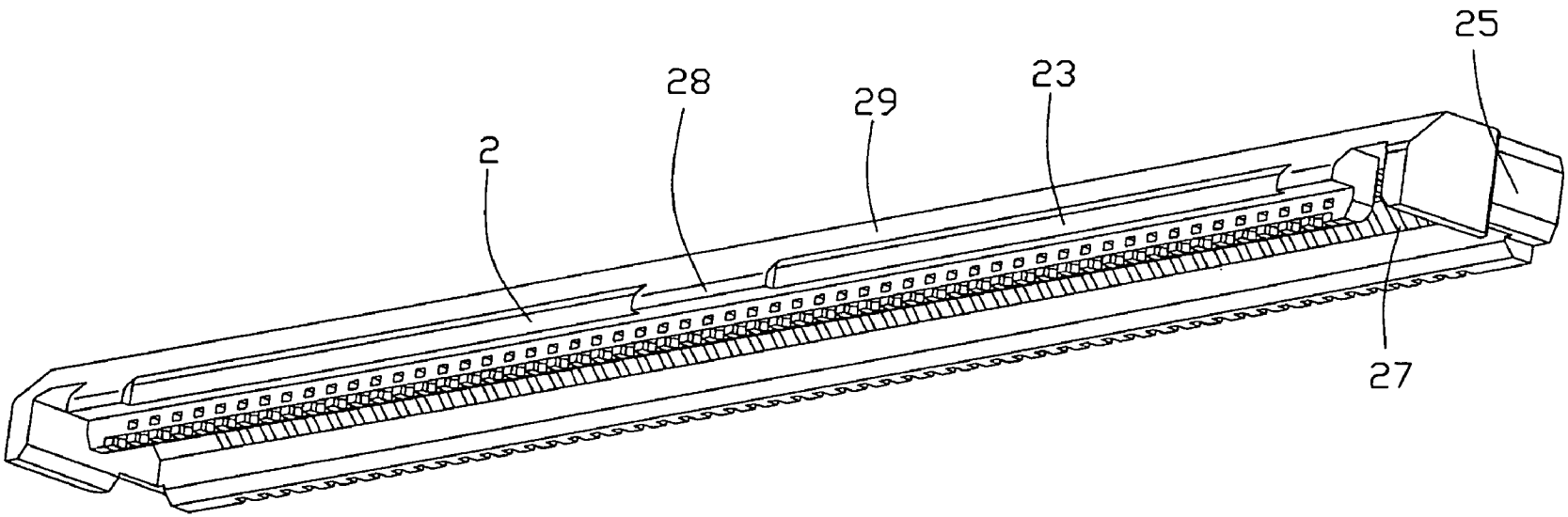
FIG. 4 is a perspective view of the insulating housing of the cable or assembly of FIG. 1.
Figure 5:
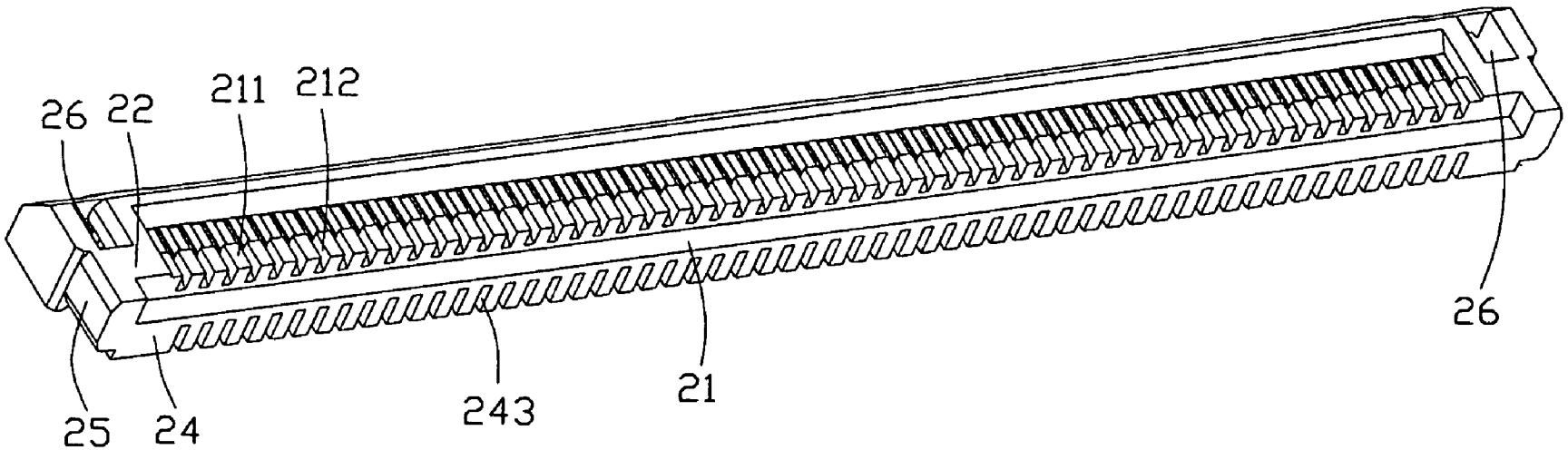
FIG. 5 is a view similar to FIG. 4, but viewed from a different angle.

Referring to FIGS. 3-5, a scalariform face 21, an up face 22, a front face 23 and a back face 24 are set on the insulating housing 2. The front face 23 cooperates with the front plate 12 of the shield 1. The back face 24 has a plurality of receiving slots 243 to receive part of contacts 27. Two fix members 25 are set on the two sides of the scalariform face 21 to fasten the locking portion 111 of the shield 1. A cavity 26 is set on the front of the fix member 25 to receive and cooperate with the insert portion 112 of the shield 1 by an interferential manner. A series of bulges 211 are set on the scalariform face 21, for receiving the cable 4, the direction of the axes of the cable 4 is perpendicular to the front plate 12 of the shield 1. A plurality of grooves 212 is defined between said bulges 211, and a number of contacts 27 are taken in the grooves 212. The insulating housing 2 has an inclined face 29 between the front face 23 and the up face 22, said inclined face 29 forms a number of projections 28 to combine with the hole 131 of the shield 1.

Referring to FIG. 2 and FIG. 6, the cable connector assembly 100 comprises two grounding bars, one is flat grounding bar 31, which is set on the metal braid 42 of the cable 4 and contacts with the tough portion 113 of the shield 1 to achieve an electrical loop; the other one is bended grounding bar 32, which comprises an insert face 321 and a cover face 322 which is perpendicular to the inserting face 321, the insert face 321 is set under the metal braid 42 and the cover face 322 covers on the back face 24 to shield the contact 27 which are received in the receiving slot 243, the cover face 322 also has several protruding points 323 for engaging a mating connector. The insulating housing 2 is covered by a front plate, a up plate and the cover face 322, the direction of the mating connector mating with the cable connector assembly 100 is perpendicular to the up plate of the shield. The insulating plate 5 is set on the flat grounding bar 31 and covers the cable 4 to separate the shield 1 and wire 44.

Figure 7:
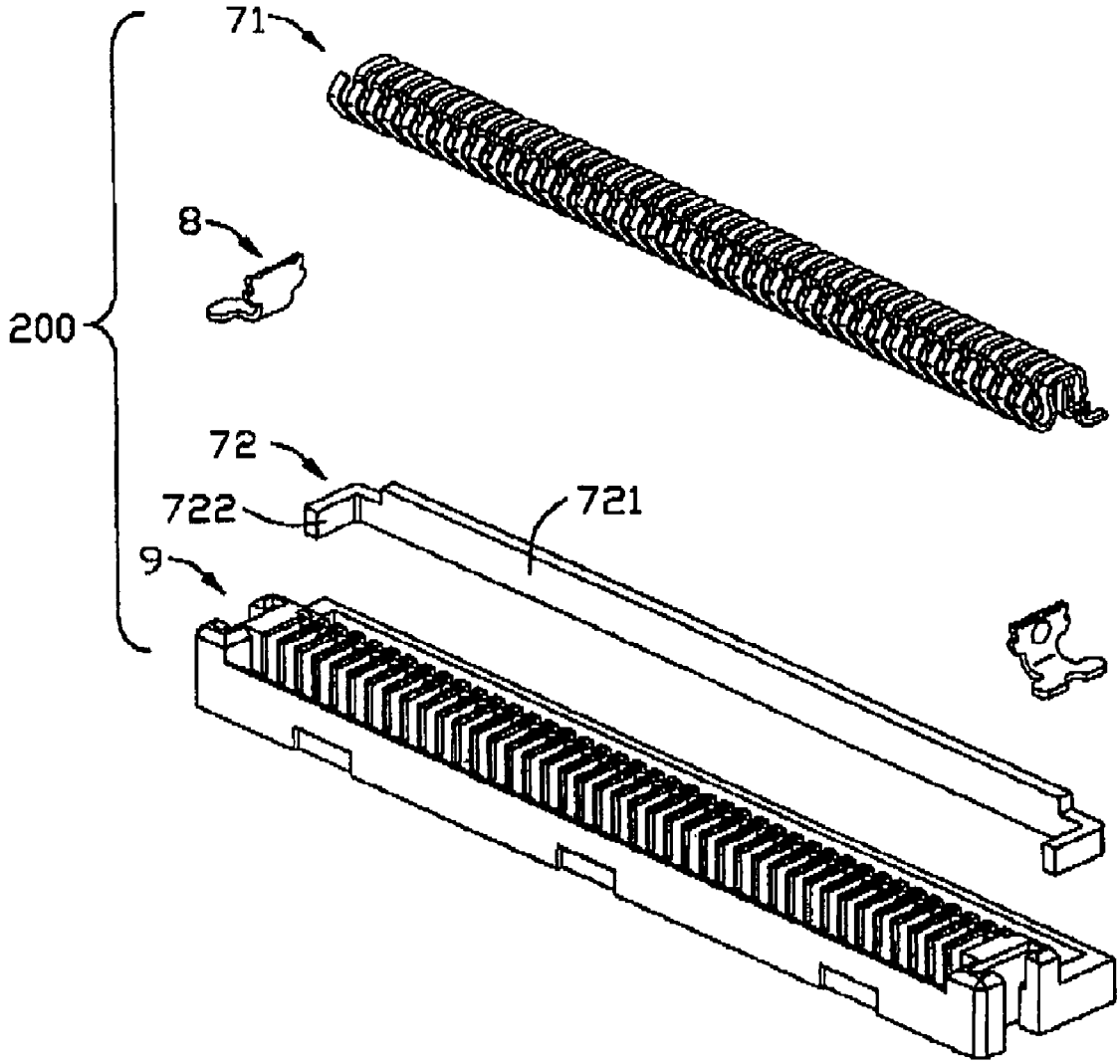
FIG. 7 is a exploded, perspective view of a board to board connector which was used to mating with present invention.
Figure 8:
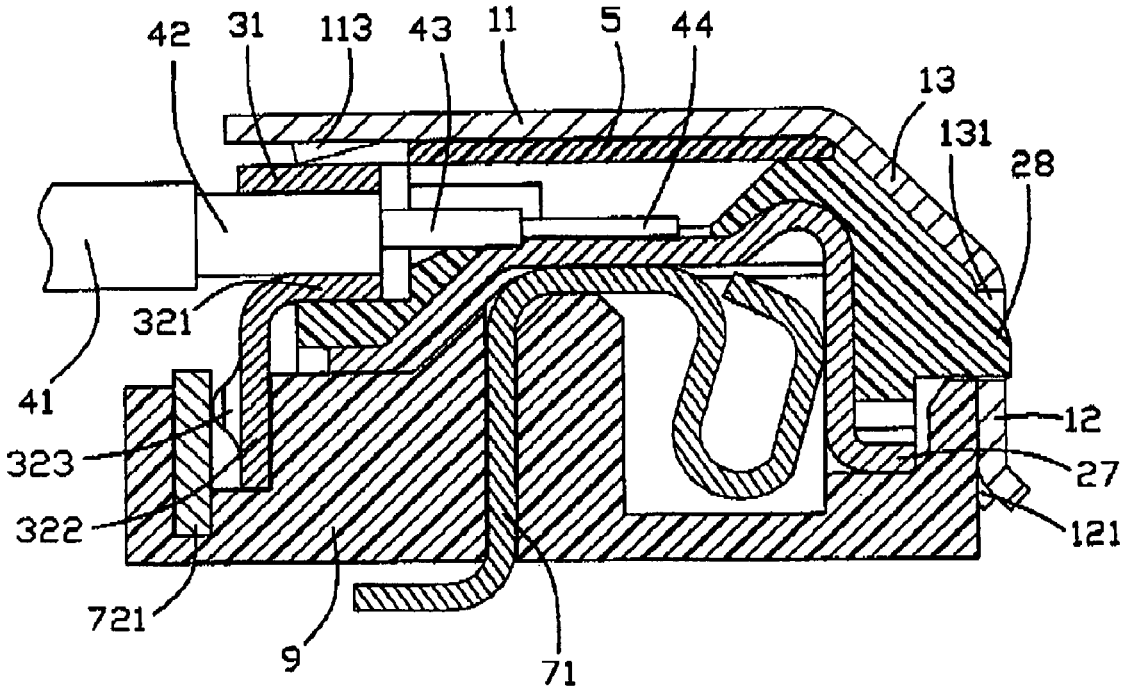
FIG. 8 is a cross-section view of present invention mating with the board to board connector shown in FIG. 7.

Referring to FIG. 7 and FIG. 8, a board to board connector 200, mating with present invention, comprising a insulating housing 9, a cover 72 fixed in the insulating housing 9, a series of terminals 71 and two ears 8. Said terminals 71 are mounted on said insulating housing 9 and connect with the contacts 27 of present invention electrically. Said two ears 8 are settled on the two sides of the insulating housing 9 to fasten the insulating housing 9 to a printed circuit board. The cover 72 has a basic portion 721 to contact the cover face 322 electrically, and has two arms 722 contacting with the ears 8 to insure the signal transmitted by the cable uninterrupted. The construction of said board to board connector 200 is just for showing the manner of the board to board connector 200 electrically mating with the cable connector assembly 100, especially the connection between the bended grounding bar 32 and the cover 72, and the invention should not be restricted within this embodiment.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field is to understand that all such equivalent structures are to be included in the scope of the following claims.

What is claimed is:

1. A cable connector assembly comprising:

a plurality of cables, viewed from center to outer, each forming a wire, an insulating layer, a metal braid layer and an insulating shroud;

at least a contact electrically connecting with said wire of the cable;

a shield having an up plate and a front plate, and a space for receiving insulating housing is formed by said up plate and front plate;

an insulating housing within said contacts received in said space defined by the shield;

a metallic bended grounding bar having an insert face and a cover face, said insert face formed between the insulating housing and the metal braid layer, the cover face covering one face of the insulating housing opposite to the front face of the shield.

2. The cable connector assembly as claimed in claim 1, wherein two lock portions and two insert portions are formed by pressing the shield in the direction of longitudinal.

3. The cable connector assembly as claimed in claim 1, wherein the direction of the cable connector mating with the mating connector is perpendicular to the axes of the cables.

4. A cable connector assembly comprising:

a plurality of cables, viewed from center to outer, each forming a wire, an insulating layer, a metal braid layer and an insulating shroud;

an insulating housing comprising a plurality of grooves for receiving said cables;

a series of contacts fixed in the insulating housing each for connecting the wire of the cable electrically;

a metal shield engaging with said insulating housing for shielding the contact;

a metallic bended grounding bar set between the insulating housing and cables, said bended grounding bar having an insert face and a cover face, the insert face electrically contacting with the braid layer of said cables and the cover face covering on the insulating housing for screening it.

5. The cable connector assembly as claimed in claim 4, wherein the cable connector assembly having a flat grounding bars connects to the braid layer.

6. The cable connector assembly as claimed in claim 4, wherein the metal shield has mechanism to cooperate with the insulating housing, and said mechanism comprises the locking portions, the inserting portions, the holes and the retaining portions.

7. The cable connector assembly as claimed in claim 4, wherein the bended grounding bar has a protruding point to impact the mating connector.

8. The cable connector assembly as claimed in claim 4, wherein the cover face electrically connects with the mating housing.

9. The cable connector assembly as claimed in claim 4, wherein the bended grounding bar has a protruding point to impact the mating connector.

10. The cable connector assembly as claimed in claim 4, wherein a plurality of bulges are set on the insulating housing to form grooves for placing the cables.

11. The cable connector assembly as claimed in claim 5, wherein the metal shield comprises touch portion to connect the flat grounding bar to transmit the charge on the braid layer of the cable.

12. The cable connector assembly as claimed in claim 6, wherein the insulating housing comprises a fix member, a cavity, a projection and a front face to engage the locking portion, the inserting portion, the hole and the retaining portion correspondingly.

13. The cable connector assembly as claimed in claim 10, wherein an insulating plate is set in front of the bulges to separate the up plate of the shield and the insulating housing.

14. A cable connector assembly comprising:

a plurality of cables, viewed from center to outer, each including a wire, an insulating layer, a metal braid layer and an insulating shroud;

an insulating housing including a plurality of grooves to respectively receive said cables;

a series of contacts fixed in the insulating housing to each connect the wire of the corresponding cable electrically;

a metallic bended grounding bar set between the insulating housing and cables, said bonded grounding bar having an insert face and a cover face, the insert face electrically contacting with the braid layer of said cables and the cover face covering the insulating housing to screen it.

15. The cable connector assembly as claimed in claim 14, wherein a metal shield engages with said insulating housing to shield the contact.

16. The cable connector assembly as claimed in claim 15, wherein the metal shield has mechanism to cooperate with the insulating housing, and said mechanism comprises the locking portions, the inserting portions, the holes and the retaining portions.

17. The cable connector assembly as claimed in claim 16, wherein the insulating housing comprises a fix member, a cavity, a projection and a front face to engage the locking portion, the inserting portion, the hole and the retaining portion correspondingly.

18. The cable connector assembly as claimed in claim 14, wherein the cover face is positioned and configured to be ready to electrically and mechanically engage a metal cover of a complementary connector when said complementary connector is mated with housing.

19. The cable connector assembly as claimed in claim 14, wherein said cover face is positioned and configured to be ready to electrical and mechanically be sandwiched between a metal cover and a dielectric base of a complementary connector when said complementary connector is mated with the housing.

20. The cable connector assembly as claimed in claim 15, wherein said grounding bar and said shield are discrete from each other.

* * * * *